United States Patent [19]

Haas

[11] 4,406,276

[45] Sep. 27, 1983

[54] STOVE

[76] Inventor: Theo Haas, Rheintalgasse 55, A-4470 Enns, Austria

[21] Appl. No.: 354,763

[22] Filed: Mar. 4, 1982

[51] Int. Cl.[3] ..... F24C 15/28

[52] U.S. Cl. ..... 126/83; 126/98; 126/99 C; 126/146

[58] Field of Search ..... 126/58, 83, 98, 99 C, 126/99 D, 119, 77, 146, 147, 151

[56] References Cited

U.S. PATENT DOCUMENTS

| | | | |
|---|---|---|---|
| 73,886 | 1/1868 | Gaston | 126/83 |
| 82,761 | 10/1868 | Smith | 126/99 C |
| 812,079 | 2/1906 | Nye | 126/98 |
| 851,985 | 4/1907 | Goldfein | 126/99 C |
| 983,566 | 2/1911 | Preuss | 126/99 C |
| 1,014,347 | 1/1912 | Strand | 126/83 |
| 1,373,737 | 4/1921 | James | 126/83 |
| 1,399,511 | 12/1921 | Moquist | 126/83 |
| 1,907,367 | 5/1933 | Ross | 126/119 |
| 2,998,806 | 9/1961 | Tramontini | 126/99 C |
| 4,291,669 | 9/1981 | Herne | 126/83 |

*Primary Examiner*—Daniel J. O'Connor

*Attorney, Agent, or Firm*—Kurt Kelman

[57] ABSTRACT

The ceramic shell of a stove encloses a firing chamber and a helical flue gas passage and is composed of superimposed blocks, each of which has the same cross-sectional shape as the corresponding height portion of the shell. The bottom block consists of a bottom tub. The uppermost block consists of a cover provided with a smoke outlet for connection to a smoke pipe. The intermediate blocks comprise at least one set of blocks which are substantially identical in shape. In order to facilitate the building of the stove and to ensure an improved utilization of the heat of the flue gases, each of the blocks has in each end face confronting an adjacent block an annular groove, which is covered by the adjacent block and contains a refractory sealing cord, which seals the joint between said adjacent blocks. The firing chamber is surrounded by a refractory insert structure, which is disposed within the blocks that surround the firing chamber. Each of the blocks that are disposed above the insert structure comprise a core, which is surrounded by one convolution of the helical flue gas passage.

6 Claims, 4 Drawing Figures

STOVE

Figure 1:
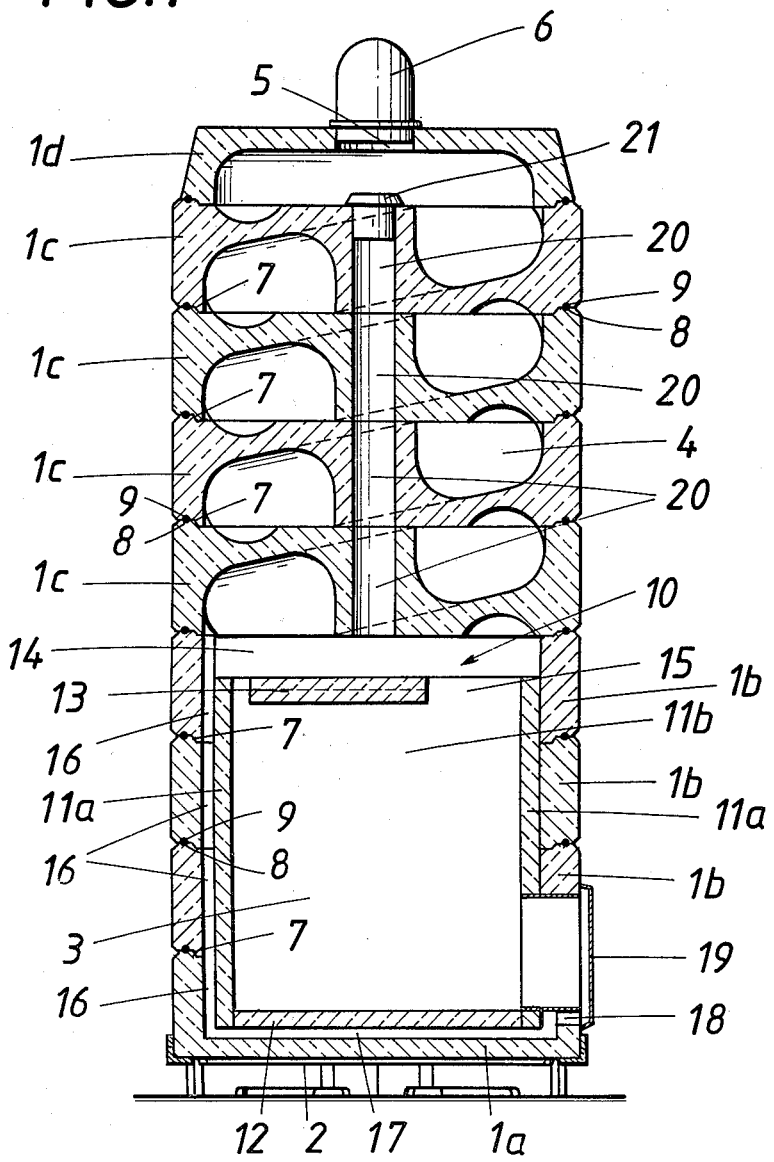

This invention relates to a stove having a base frame, a ceramic shell, which encloses a firing chamber and a helical flue gas passage above said firing chamber and is composed of superimposed blocks, each of which has the same cross-sectional shape as the corresponding height portion of the stove, adjacent ones of said blocks being formed at confronting end faces with complementary, axially offset centering portions, said blocks comprising a bottom block consisting of a bottom tub supported by said base frame, a top block consisting of a cover having a smoke outlet communicating with said flue gas passage, and intermediate blocks comprising at least one set of blocks which are substantially identical in shape, and a refractory insert structure contained in said shell and defining said firing chamber.

In comparison with other stoves, tile stoves afford considerable advantages regarding the combustion of the fuel, the ability to store heat and the delivery of heat but have the disadvantage that they must be erected on suitable foundations. For this reason the building of a tile stove involves a substantial amount of work of a highly skilled person and a high expenditure.

In an endeavor to provide a stove which can be built in a simple manner, it has already be proposed in Austrian Patent Specification No. 106,081 to compose the shell of the stove of layers consisting of ceramic blocks, each of which constitutes has the same cross-sectional shape as the corresponding height portion of the stove and which are provided with tapering centering extensions intended to facilitate the fitting of the blocks one over the other because the blocks are automatically centered by said extensions. But this gives rise to a radially outwardly directed pressure so that the annular rims provided with the centering extensions may break out. For this reason, reinforcing rings are required adjacent to the centering extensions, as has been proposed in German Patent Specification No. 361,797.

An adequate seal between the blocks which are simply placed one on the other cannot be ensured. For this reason the blocks must be bonded with mortar so that the advantages which are due to the simplified placing of the blocks are largely offset. Besides, the firing chamber is defined by the blocks themselves and by a rear wall, which has been inserted into and snugly contacts said blocks. For this reason, the blocks may be mechanically damaged, e.g., by fuel pushed into the firing chamber. Moreover, the surface which is available for the heat transfer between the flue gas and the blocks is relatively small because the blocks define only flue gas chambers having mutually offset inlet and outlet openings so that the flue gas passage has dead spaces in which substantial quantities of soot may become deposited. As a result, the flue system must be cleaned after a relatively short firing time. On the other hand, it is almost impossible to clean the stove because the flue gas passage is angled owing to the design of the stove.

Whereas the angularly offset inlet and outlet openings of the flue gas chambers defined by the blocks may be so arranged that a helical flue gas passage is obtained, which is longer than a straight flue gas passage would be, that increased length can hardly be utilized for an improved utilization of heat because the inlet and outlet openings are offset by not more than 90° so that at least four superimposed blocks are required for a complete convolution.

It is an object of the invention to avoid these disadvantages and so to improve a stove of the kind described first hereinbefore that the shell can be built substantially in that the blocks are placed one on the other and that the sensible heat of the flue gases can be utilized to a high degree.

This object is accomplished according to the invention in that each of the blocks is formed in each end face that faces an adjacent block with an annular groove, which is covered by the adjacent block and accommodates a refractory sealing cord, that the refractory insert structure surrounds the firing chamber, and each block of a set of blocks disposed above the refractory insert structure has a core portion and defines around said core portion at least one convolution of a helical flue gas passage.

As each block is formed in each end face confronting another block with an annular groove, which contains a refractory sealing cord, and the next upper block is forced against said sealing cord by its own weight and the weight of any overlying blocks, there will be gas-tight joints between the blocks without need for mortar, particularly because the firing chamber is surrounded by the insert structure, which provides for a higher mechanical strength of the shell adjacent to the firing chamber and for an additional seal. In addition to performing these functions, the insert provided according to the invention will protect the blocks from mechanical damage as the insert surrounding the firing chamber virtually constitutes a liner for the blocks.

A large heat transfer surface between the flue gas passage and the blocks is required to ensure that the sensible heat will be extracted from the flue gases. That requirement can be met in a highly advantageous manner in that each block defines at least one convolution of a helical flue gas passage. Additional convolutions of the flue gas passage can be provided in that respective blocks are added. This permits a good adaptation of the height of the stove to the flue gas temperatures. An additional advantage afforded by the helical flue gas passage extending around a core portion resides in that the flue gas passage is free from dead spaces, which would promote a deposition of soot. As a result, the stove can be operated for a much longer time before it must be cleaned and the cleaning work will be greatly simplified.

The uniform and rapid heating of the blocks which define the flue gas passage can be promoted in that each block which defines a convolution of the helical passage has a core portion, which is surrounded by the convolution of the helical passage and formed with an axial through opening, which is adapted to be closed by a cover. When such blocks are placed one on the other, a central passage will be obtained, which can be closed at the top by a cover so that the heat retained in that central passage can be absorbed by the core portions of the blocks. Besides, a heat exchanger of a low-temperature heating system, e.g., a floor-heating system, may be inserted in the central passage consisting of the axial through openings in the core portions of the blocks. In that way the utilization of the sensible heat of the flue gases can be further improved.

According to a further improvement, the blocks disposed adjacent to the insert structure which surrounds the fieing chamber are formed with an axial groove, which is open toward the insert structure and communicates with an air supply passage formed in the bottom tub. This design will ensure a satisfactory afterburning of any fuel which may be entrained by the flue leaving the firing chamber because fresh air will be supplied through the axial groove into an afterburning chamber. As said axial groove is formed in all blocks disposed adjacent to the firing chamber, the length of the fresh air passage formed by the axial groove will be increased automatically whenever one of such blocks is added.

The building of the stove will be greatly simplified if the insert structure which surrounds the firing chamber consists of wall panels which snugly contact the blocks and support each other and are spaced apart by means of a bottom panel and a top panel, which separates the firing chamber from an after-burning chamber and is formed with fire openings. To construct the insert structure, it will be sufficient to place the panels of the insert structure inside the previously placed blocks surrounding the firing chamber. These panels constitute a smooth-surfaced liner around the firing chamber and stiffen the blocks so that the stove will be as safe as is required.

As the prefabricated blocks need not be provided with mortar or with a sheath, the visible surface of the blocks may be provided with a glaze. The design of said visible surfaces may be selected as desired. Special shaped blocks having different visible surfaces are placed one over the other.

Figure 2:
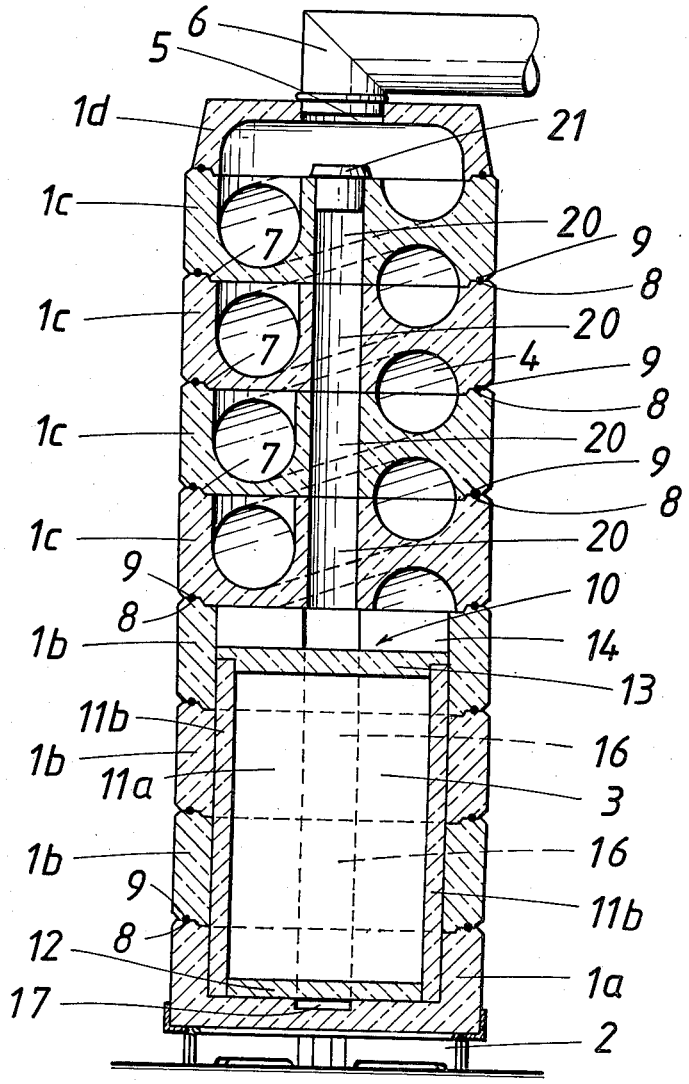
Figure 3:
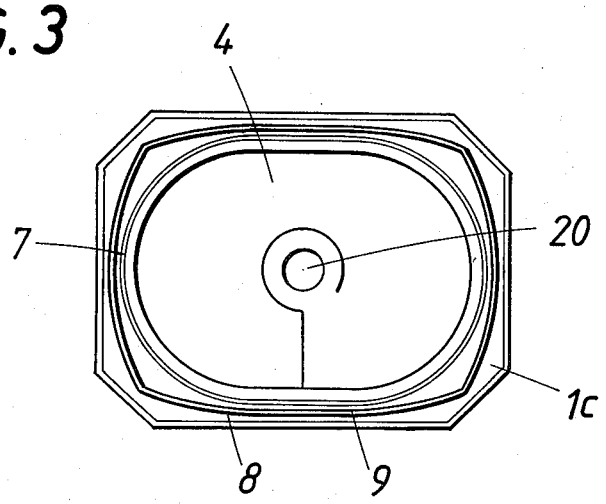
Figure 4:
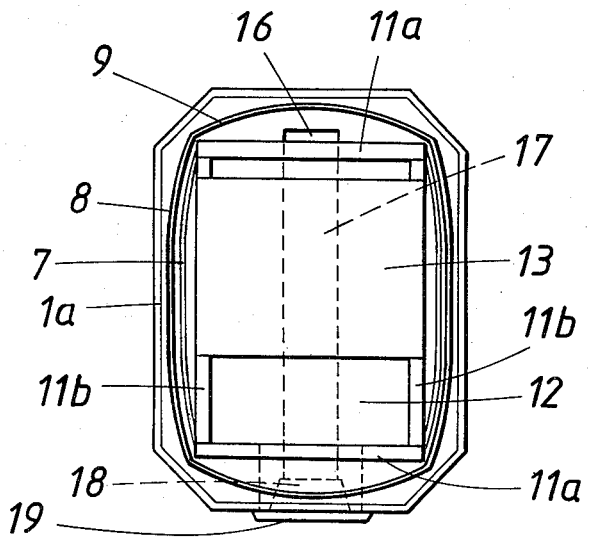

A simplified embodiment of the invention is shown by way of example on the drawing, in which FIG. 1 is a longitudinal sectional view showing a stove according to the invention, FIG. 2 is a sectional view on a plane that is at right angles to the section plane of FIG. 1, FIG. 3 is a top plan view showing a block defining a flue gas passage and FIG. 4 is a top plan view showing the lowermost block, which constitutes a bottom tub.

The stove shown on the drawings has a shell consisting of prefabricated blocks, which are superimposed and have the same cross-sectional shape as the corresponding height portions of the stove. The lowermost block 1*a* constitutes a bottom tub, which is supported by a base frame 2 and carries blocks 1*b*, which surround a firing chamber 3. The blocks 1*b* are identical in shape and carry blocks 1*c*, which are also identical in shape and define a flue gas passage 4. The top block 1*d* carried by the blocks 1*c* constitutes a cover, which is provided with a smoke outlet 5, which communicates with the passage 4 and is connected to a smoke pipe 6, which has been fitted into the outlet 5 in conventional manner.

In order to ensure that adjacent blocks will be properly positioned relative to each other, adjacent blocks are formed on adjacent end faces with mutually complementary, axially offset centering portions 7, which interengage when one block is placed on another. A gastight joint between adjacent blocks is formed by a refractory sealing cord 9, which extends in registering annular grooves 8 formed in adjacent end faces of adjacent blocks. Such sealing cords are known per se and commercially available.

In order to provide a liner around the firing chamber 3 and to stiffen the shell of the stove around the firing chamber 3, a refractory insert structure 10 consisting of interengaging parts is disposed in and snugly contacts the blocks 1*b*. That insert structure consists of a firebox composed of four wall panels 11*a* and 11*b*, a bottom panel 12, and a top panel 13. The mutually opposite wall panels 11*a* are forced by the wall panels 11*b* against the blocks 1*b*. The bottom panel 12 lies in the bottom tub 1*a*. The top panel 13 has a stepped edge portion extending between the wall panels 11*b*. The bottom panel 12 and the top panel 11*b* properly support the wall panels 11*b* so that the insert structure 10 is self-stiffening without need for special connecting means.

The top panel 13 of the insert structure 10 separates the firing chamber 3 from an afterburning chamber 14, which communicates with the firing chamber 3 through fire openings 15 in the top panel 13. For a complete combustion of any fuel which may be entrained by the flue gases leaving the firing chamber 3, fresh air can be supplied to the afterburning chamber 14 through an axial groove 16, which is forced in the blocks 1*b* and constitutes a fresh air passage, which through a groove 17 formed in the bottom tub 1*a* communicates with an air supply passage 18 formed adjacent to the firedoor 19.

To ensure that the firedoor 19 can easily be inserted into the blocks, the bottom block 1*a* has a suitable recess, which is continued in the next upper block 1*b*. When the bottom block 1*a* has been placed, the firedoor 19 can be inserted into the recess of the bottom block 1*a* and the next upper block 1*b* is placed on the bottom block 1*a* so as to receive the top part of the firedoor.

Each of the blocks 1*c* defines one convolution of the helical passage 4 so that the latter can be increased in length in that another block 1*c* is added. The removal of the blocks 1*c* from the molds will be facilitated and a turbulencing of the flue gas will be ensured if the openings for the flue gases are flattened in the regions where undercuts would otherwise be obtained. This is indicated in FIGS. 1 and 2. Each block has a core, which is surrounded by the flue gas passage 4 and which is formed with an axial through opening 20 so that the superimposed blocks 1*c* define a central passage, which can be closed by a cover 21 that is inserted into the uppermost block 1*c*. Hot gas from the afterburning chamber 14 can rise in that central passage so that the cores of the blocks 1*c* will be heated more quickly and in a more uniform manner.

It is apparent that all advantages of a tile stove are actually afforded by the stove according to the invention whereas the drawbacks of a tile stove can be avoided. The shell of the stove can easily be built in that the various blocks are placed one on the other. The number of blocks which are used can be freely selected so that stoves for use under widely different conditions can be built. As the several parts of the stove need not be bonded by mortar, the stove can easily be dismantled and rebuilt or increased or decreased in size when this may be required.

As is apparent from FIG. 3 the convolutions of the flue gas passage 4 need not be circular in cross-section. The flue gas passage might alternatively be defined by a helical surface, which extends from the core of each block 1*c* and in each block 1*c* extends over 360°.

What is claimed is:

1. In a stove comprising a base frame, a ceramic shell, which encloses a firing chamber and a helical flue gas passage above said firing chamber and is composed of superimposed blocks, each of which has the same cross-sectional shape as the corresponding height portion of the stove, adjacent ones of said blocks being formed at confronting end faces with complementary, axially offset centering portions, said blocks comprising a bottom block consisting of a bottom tub supported by said base frame, a top block consisting of a cover having a smoke outlet communicating with said flue gas passage, and intermediate blocks comprising at least one set of blocks which are substantially identical in shape, and a refractory insert structure contained in said shell and defining said firing chamber, the improvement residing in that each of said blocks is formed in an end face that faces another of said blocks with an annular groove, which is covered by said other block, refractory sealing cords are disposed in respective ones of said grooves and seal the joints between adjacent ones of said blocks, said refractory insert structure surrounds said firing chamber and extends only over part of the height of said shell, and said blocks comprise a set of blocks which are disposed above said insert structure and each of which has a core portion and defines around said core portion at least one convolution of said helical flue gas passage.

2. The improvement set forth in claim 1, wherein the core of each block of said set of blocks disposed above said insert structure is formed with an axial through opening, said axial through openings communicate with each other and a cover is mounted on the uppermost block of said set of blocks disposed above said insert and closes said axial through opening of said uppermost block of said set.

3. The improvement set forth in claim 1, wherein an axial groove which is open toward said refractory insert structure is formed in said blocks surrounding said firing chamber, and said bottom tub is formed with an air supply passage, which is open on the outside of said stove and communicates with said axial groove.

4. The improvement set forth in claim 1, wherein said refractory insert structure comprises a top portion, which extends over said firing chamber and defines an afterburning chamber with the lowermost block of said set of blocks disposed above said insert structure and is formed with fire openings through which said afterburning chamber communicates with said firing chamber.

5. The improvement set forth in claim 4, wherein an axial groove which is open toward said refractory insert structure is formed in said blocks surrounding said firing chamber, said bottom tub is formed with an air supply passage, which is open on the outside of said stove and communicates with said axial groove, and said axial groove opens into said afterburning chamber.

6. The improvement set forth in claim 4, wherein said refractory insert structure consists of a firebox, which is composed of a bottom panel placed in said bottom tub, a top panel, which constitutes said top portion, and wall panels, which support each other and are spaced apart by said bottom panel and said top panel and are in snug contact with those of said blocks which surround said firing chamber.

* * * * *